US007554504B2

(12) United States Patent
Mohamadi

(10) Patent No.: US 7,554,504 B2
(45) Date of Patent: Jun. 30, 2009

(54) INTEGRATED CIRCUIT BEAMFORMING HORN ARRAY

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 171 days.

(21) Appl. No.: 11/774,476

(22) Filed: Jul. 6, 2007

(65) Prior Publication Data

US 2007/0252768 A1 Nov. 1, 2007

Related U.S. Application Data

(63) Continuation-in-part of application No. 11/536,625, filed on Sep. 28, 2006, which is a continuation-in-part of application No. 11/182,344, filed on Jul. 15, 2005, now Pat. No. 7,321,339, which is a continuation-in-part of application No. 11/141,283, filed on May 31, 2005, now Pat. No. 7,312,763.

(51) Int. Cl.
*H01Q 13/00* (2006.01)

(52) U.S. Cl. ..... 343/776; 343/786

(58) Field of Classification Search ..... 343/772, 343/776, 777, 778, 786, 700 MS, 853
See application file for complete search history.

(56) References Cited

U.S. PATENT DOCUMENTS 5,568,160 A * 10/1996 Collins ..... 343/778
6,061,026 A * 5/2000 Ochi et al. ..... 343/700 MS
6,064,350 A * 5/2000 Uchimura et al. ..... 343/786
6,870,503 B2 3/2005 Mohamadi
6,885,344 B2 4/2005 Mohamadi
6,963,307 B2 11/2005 Mohamadi
6,982,670 B2 1/2006 Mohamadi
7,019,707 B2 * 3/2006 Gottwald et al. ..... 343/786
7,126,541 B2 10/2006 Mohamadi
7,126,542 B2 10/2006 Mohamadi
7,126,554 B2 10/2006 Mohamadi
2006/0220974 A1 * 10/2006 Sakakibara et al. ..... 343/772

OTHER PUBLICATIONS

B. Kleveland, et al, Exploiting CMOS Reverse Interconnect Scaling in Multigigahertz Amplifier and Oscillator Design, IEEE Journal of Solid-State Circuits, Oct. 2001, vol. 36.
N. Barker, et al, Optimization of Distributed MEMS Transmission-Line Phase Shifters-U-Band and W-Band Designs, Nov. 2000, pp. 1957-1965 vol. 48 No. 11.
R. A. Pucel, et al, Losses in Microstrip, IEEE MTT-S Transaction, Jun. 1968, vol. MTT-16.
J. Bornemann, F. Arndt, Rigorous Design of Evanescent-mode E-plane Waveguide Bandpass Filter, IEEE MTT-S Digest, 1989, pp. 603-606.
J. Hirokawa, A Single-Layer Slotted Leaky Waveguide Array Antenna for Mobile Reception of Direct Broadcast from Satellite, IEEE Transaction on Vehicular Technology, Nov. 1995.
T. Sehm, et al, "A Large Planar 39 GHz Antenna Array of Waveguide-Fed Horn," IEEE Transaction on Antenna and Propagation, Aug. 1998, pp. 1189-1193, vol. 46 No. 8.

* cited by examiner

*Primary Examiner*—Hoang V Nguyen
(74) *Attorney, Agent, or Firm*—Haynes & Boone, LLP.

(57) ABSTRACT

In one embodiment, an integrated circuit horn array is provided that includes: a first substrate including a plurality of horn antennas, the horn antennas being isolated by cavities in the first substrate between the horn antennas. A second substrate supports an RF feed network that either resonantly or linearly excites the horn antennas.

14 Claims, 10 Drawing Sheets

INTEGRATED CIRCUIT BEAMFORMING HORN ARRAY

RELATED APPLICATION

This application is a continuation-in-part of U.S. application Ser. No. 11/536,625, filed Sep. 28, 2006, which in turn is a continuation-in-part of U.S. application Ser. No. 11/182,344, filed Jul. 15, 2005, now U.S. Pat. No. 7,321,339, which in turn is a continuation-in-part of U.S. application Ser. No. 11/141,283, filed May 31, 2005 now U.S. Pat. No. 7,312,763.

TECHNICAL FIELD

The present invention relates generally to integrated circuits, and more particularly to an integrated beamforming array.

BACKGROUND

Conventional beamforming systems are often cumbersome to manufacture. In particular, conventional beamforming antenna arrays require complicated feed structures and phase-shifters that are impractical to be implemented in a semiconductor-based design due to its cost, power consumption and deficiency in electrical characteristics such as insertion loss and quantization noise levels. In addition, such beamforming arrays make digital signal processing techniques cumbersome as the operating frequency is increased. Moreover, at the higher data rates enabled by high frequency operation, multipath fading and cross-interference becomes a serious issue. Adaptive beamforming techniques are known to combat these problems. But adaptive beamforming for transmission at 10 GHz or higher frequencies requires massively parallel utilization of A/D and D/A converters.

To provide a beamforming system compatible with semiconductor processes, the applicant has provided a number of integrated antenna architectures. For example, U.S. application Ser. No. 11/454,915, the contents of which are incorporated by reference, discloses a beamforming system in which an RF signal is distributed through a transmission network to integrated antenna circuits that include a beamforming circuit that adjusts the phase and/or the amplitude of distributed RF signal responsive to control from a controller/phase manager circuit. In a receive configuration, each beamforming circuit adjusts the phase and/or the amplitude of a received RF signal from the corresponding integrated circuit's antenna and provides the resulting adjusted received RF signal to the transmission network. Although such integrated antenna circuits consume a relatively small amount of power, transmission loss is incurred through the resulting RF propagation in the transmission network. To account for such loss, U.S. application Ser. No. 11/454,915 discloses a distributed amplification system such that RF signals propagated through the transmission network are actually amplified rather than attenuated. However, the transmission network introduces dispersion as well.

To avoid the dispersion introduced by an RF transmission network, an alternative integrated circuit (which may also be denoted as an integrated oscillator circuit) has been developed such as disclosed in U.S. Pat. No. 6,982,670. For example, each integrated oscillator/antenna circuit may include an oscillator such as a phase-locked loop (PLL) and a corresponding antenna and mixer. In such an embodiment, each PLL is operable to receive a reference signal and provide a frequency-shifted signal output signal that is synchronous with the reference signal. Should an integrated oscillator/antenna circuit be configured for transmission, its output signal is upconverted in the unit's mixer and the upconverted signal transmitted by the corresponding antenna. Alternatively, should an integrated oscillator/antenna circuit be configured for reception, a received RF signal from the unit's antenna is downconverted in the mixer responsive to the frequency-shifted output signal from the PLL. Although the integrated oscillator circuit approach does not have the dispersion issues resulting from propagation through a transmission network, the inclusion of an oscillator in each integrated oscillator circuit demands significantly more power than the transmission network approach.

To avoid the dispersion resulting from propagation through a transmission network and also the expense of an integrated oscillator approach, a distributed oscillator architecture has been developed as disclosed in U.S. application Ser. No. 11/536,625. In this architecture, a resonant transmission network with distributed amplification is driven by a triggering pulse waveform such that the entire transmission network oscillates acting as a distributed oscillator. In this fashion, high frequency RF signals and/or narrowband pulses from the resonant transmission signal are coupled in a globally synchronized fashion to the various integrated antennas. Each antenna (or a subset of antennas) may include a phase-shifter and/or attenuator to provide beamforming capabilities. Although this resonant approach is compatible with conventional semiconductor processes, the smaller dimensions of modern semiconductor processes are not compatible with large voltages. For example, it is conventional in certain CMOS processes to limit signal voltages to 2.5 V or even 1.5V or less. Voltages in excess of these limits may damage the devices or cause long term reliability issues adversely impacting their performance. This limit on voltage places a limit on the amount of transmittable power that can be delivered to the antennas.

Modern semiconductor manufacturing processes not only place a limit on the achievable transmit power but also on the achievable antenna geometry and construction. Accordingly, there is a need in the art for integrated beamforming solutions that utilize an efficient and cost-effective antenna array.

SUMMARY

In accordance with an aspect of the invention, an integrated circuit horn array is provided that includes: a first substrate including a plurality of horn antennas, the horn antennas being isolated by cavities in the first substrate between the horn antennas; a second substrate adjacent the first substrate; an RF feed network adjacent the second substrate and coupled to the pulse shaping circuit, the RF feed network being configured to propagate an RF signal to the plurality of horn antennas, and a distributed plurality of amplifiers integrated with the second substrate and operable to amplify the RF signal propagated through the RF feed network.

In accordance with another aspect of the invention, an integrated circuit horn array is provided that includes: a first substrate including a plurality of horn antennas, the horn antennas being isolated by cavities in the first substrate between the horn antennas; a second substrate adjacent the first substrate; and an RF feed network adjacent the substrate, the RF feed network coupling to a distributed plurality of amplifiers integrated with the second substrate, wherein the RF feed network and the distributed plurality of amplifiers are configured to form a resonant network such that if a timing signal is injected into an input port of the RF feed network, the resonant network oscillates to provide a globally synchronized RF signal to each of the horn antennas.

The invention will be more fully understood upon consideration of the following detailed description, taken together with the accompanying drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
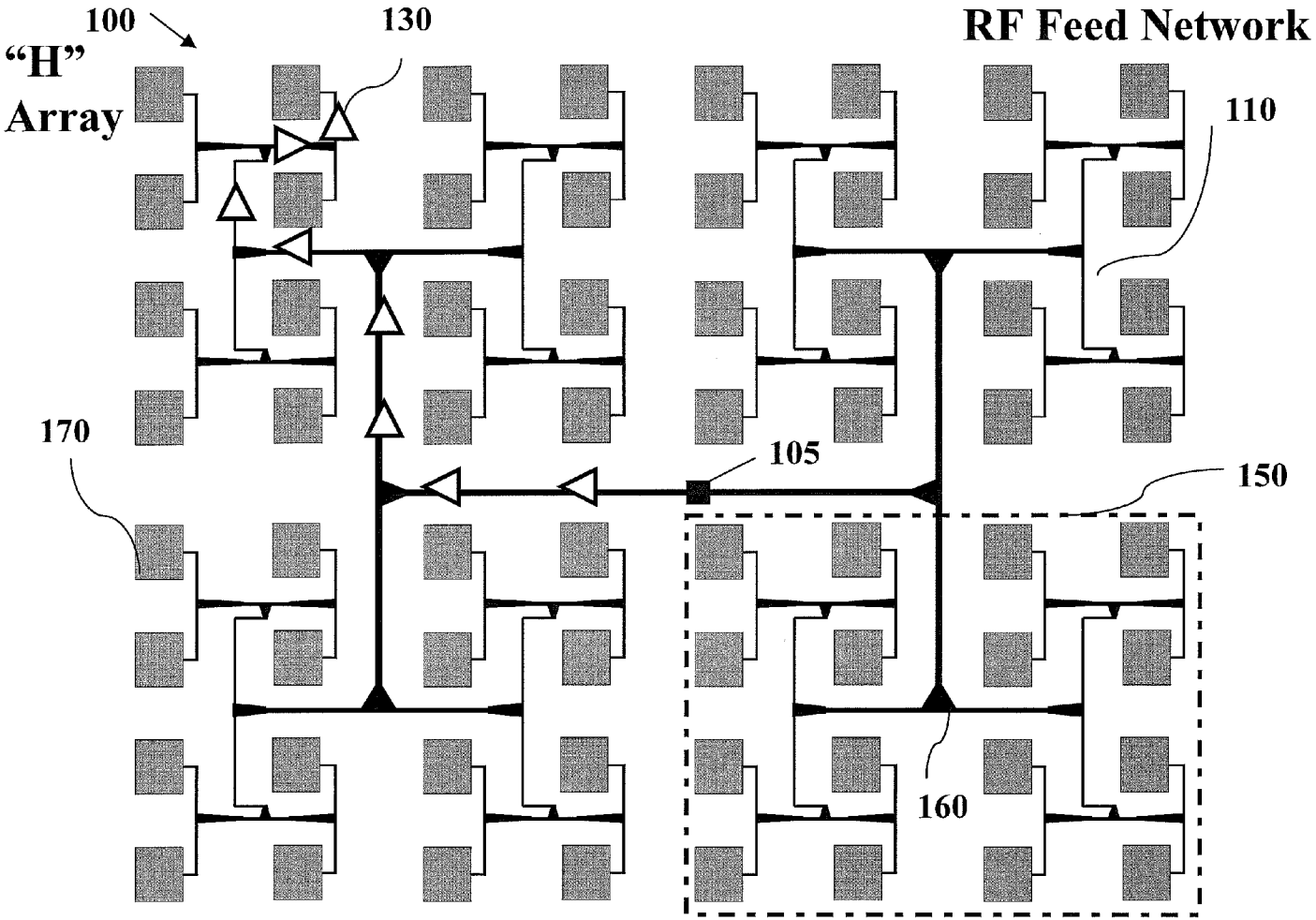
FIG. 1 is a plan view of a wafer scale antenna module having a transmission network supporting resonant oscillation or linear amplification through a plurality of distributed amplifiers.

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

To provide a high performance array that is compatible with an integrated circuit approach, a horn-based antenna array is disclosed. This horn array is manufactured from a semiconductor substrate (or other suitable substrates) using conventional semiconductor manufacturing processes such as isotropic and anisotropic etching. As will be explained further, the horns are separated by cavities for enhanced electrical isolation. The substrate defining the horn antenna array interfaces with another substrate in which the feed network and phase shifters are implemented. For clarity, the antenna substrate is referred to herein as macro layer I whereas the substrate holding the feed network and phase shifters is referred to as macro layer II. Should multiple arrays be implemented (each having their macro layers I and II), a third layer denoted as macro layer III is optional for synchronizing the various arrays. Because the substrates used to form macro layers I and II may each comprise an entire wafer section, the resulting array may be denoted as a wafer scale antenna module (WSAM). It will be appreciated, however, that the substrate need not encompass an entire wafer section. The larger the substrate, the greater the number of horn antennas that may be supported. It is believed that an eight inch semiconductor wafer substrate may support an array of 1024 horns for 44.5 GHz operation.

The RF signal transmitted by the horn antennas may be centrally generated and distributed through a transmission network. Such architectures are denoted herein as RF distribution architectures. Alternatively, each antenna (or a subset of antennas) in the array may be associated with its own oscillator such as a phase-locked loop (PLL). Each antenna (or subset of antennas) and its associated oscillator may be denoted herein as an integrated antenna circuit. The RF distribution architectures will be discussed first.

RF Distribution Architectures

In an RF distribution architecture, the RF signal to be transmitted through the horn antennas is provided by a transmission network such as a microstrip or coplanar waveguide (CPW) network. However, CPW enjoys superior shielding properties over microstrip. Thus the following discussion will assume without loss of generality that the transmission network is implemented using CPW. The CPW network may receive an RF signal to be transmitted at an input port such that the RF signal then propagates through the transmission network to the various horn antennas. Because a wafer-scale-size CPW network may introduce losses in excess of 100 dB as the RF signal propagates across an 8" wafer, distributed amplifiers may be associated with the CPW network as discussed further herein. In an alternative embodiment, the distributed amplifiers and the CPW network may be configured such that the network resonantly oscillates in unison.

Because both networks (linear or resonant) include a plurality of distributed amplifiers associated with the CPW network, they may be illustrated by the CPW transmission network 110 of FIG. 1, assuming a half-duplex operation. It will be appreciated, however, that a linear CPW network having distributed amplification may be configured for full-duplex operation. Network 110 is implemented in an 8" wafer scale antenna module (WSAM) 100 coupled to 64 horn antenna elements 170. Should CPW network be resonant, it may also be denoted as a central clock distribution network because of the global synchronization provided by the resonant operation of network 110. For linear operation, the RF signal to be transmitted is provided to a center feed point 105. This RF signal then propagates through the CPW network with linear amplification provided by the distributed amplifiers 130. As discussed in U.S. patent application Ser. No. 11/454,915, filed Jun. 16, 2006, the contents of which are incorporated by reference, linear operation is enhanced by configuring the distributed amplifiers into driving amplifier and matching amplifier pairs. As discussed further in U.S. patent application Ser. No. 11/454,915, transmission through the network is low loss and low noise because the driver and matching amplifiers are tuned with reactive components only—no resistive tuning (and hence corresponding loss) need be implemented.

Should the network and the distributed amplifiers be configured for resonant operation, no matching amplifiers need be included. The triggering signal to trigger the resonant oscillation is injected into center feed point 105. Distributed amplifiers 130 coupled to the network then injection lock to each other such that each antenna 170 may receive a globally-synchronized RF signal. In contrast to the resonant transmission network, a half-duplex receiving CPW network (not illustrated) for wafer scale antenna module 100 would operate in the linear amplification regime as described for the distributed amplification architecture disclosed in U.S. patent application Ser. No. 11/454,915. Further details for resonant globally synchronized operation are disclosed in U.S. patent application Ser. No. 11/536,625.

Just as active circuitry is distributed across the CPW network for amplification (using, e.g., the matching and driving amplifiers discussed previously), active circuitry may also be used to form distributed phase shifters as will be explained further herein. The location of the distributed phase shifters depends upon the granularity desired for the beam steering capability. For example, each antenna element 170 could receive individual phase shifting through an adjacent and corresponding distributed phase shifter. To save costs and reduce power consumption, subsets of antenna elements 170 may share in the phase shifting provided by a corresponding distributed phase shifter. For example, consider a subset 150 having sixteen antenna elements 170. As seen in FIG. 1, a distributed phase shifter located adjacent an intersection 160 of network 110 would provide equal phase shifting for each of the elements within subset 150. Similar subsets would have their own distributed phase shifter. It may thus be appreciated that the granularity of the beam steering capability is a design choice and depends upon desired manufacturing costs and associated complexity. Any suitable digital phase shifter (a discrete set of achievable phase shifts) or analog phase shifter (a continuously variable phase shift) may be used with WSAM 100. A particularly advantageous analog phase shifter is disclosed in U.S. patent application Ser. No. 11/535,928, the contents of which are incorporated by reference herein.

Integrated Oscillator Embodiments

Figure 2:
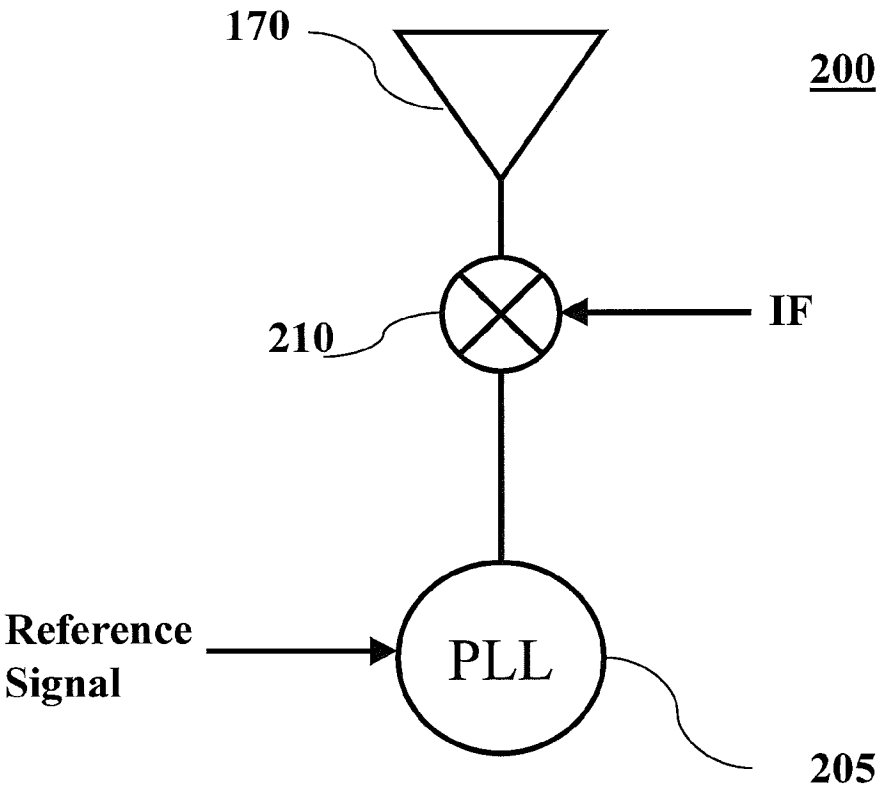
FIG. 2 is a high-level schematic illustration of an integrated antenna circuit.

Rather than distribute an RF signal (for either transmission or during a receive operation), each antenna 170 (or subset of antennas) may be associated with an oscillator 205 such as a PLL to form an integrated antenna circuit 200 as illustrated in FIG. 2. The oscillator provides a local oscillator (LO) signal that upconverts an intermediate frequency (IF) signal in a mixer 210 to provide an RF signal for driving antenna 170. Phase-shifting for beamforming purposes may be provided by shifting the reference signal provided to PLL 205. A master PLL (not illustrated) may include in its feedback loop a programmable phase sequencer that provides phase-shifted versions of a master clock as reference signals for slave PLLs such as PLL 205. Alternatively, a centralized programmable phase sequencer may generate phase-shifted versions of a master clock as the reference signal for each PLL 205. Further details for exemplary integrated antenna circuits are disclosed in U.S. Pat. No. 6,982,670, the contents of which are incorporated by reference herein.

Regardless of whether an RF distribution architecture or an integrated oscillator architecture is implemented, the corresponding active circuitry is integrated into the semiconductor substrate that forms macro layer II discussed previously. This semiconductor substrate will have a surface that faces macro layer I and an opposing surface that does not face macro layer I. As discussed, for example, in U.S. application Ser. No. 11/384,589, the contents of which are incorporated by reference, the active circuitry may be integrated in the opposing surface in a "backside" configuration. Such a configuration is advantageous in that the active circuitry is better shielded from the antennas. Moreover, the RF transmission network may be formed in semiconductor processing metal layers associated with the backside without complication from routing issues relating to antenna coupling. However, a "frontside" integration as discussed for example, in U.S. patent application Ser. No. 11/536,625, the contents of which are incorporated by reference, has the advantage of being compatible with conventional semiconductor manufacturing processes.

In a resonant embodiment, macro layer II may be formed using a low voltage substrate for distributing the RF signals to the antennas. To provide greater transmitting power, macro layer II may also include a high-bandgap semiconductor substrate (which may also be denoted as a high-voltage substrate) such as gallium arsenide, indium phosphide, or gallium nitride. This high-voltage substrate would include a switching power amplifier for each antenna (or subset of antennas). In this fashion, the phase-shifted RF signal distributed by the low-voltage semiconductor substrate discussed with regard to FIG. 1 is high-power amplified before being transmitted through the horn antennas. Further details regarding exemplary high-voltage substrates and corresponding switching power amplifiers may be found in U.S. patent application Ser. No. 11/616,235, the contents of which are incorporated by reference.

Figure 3:
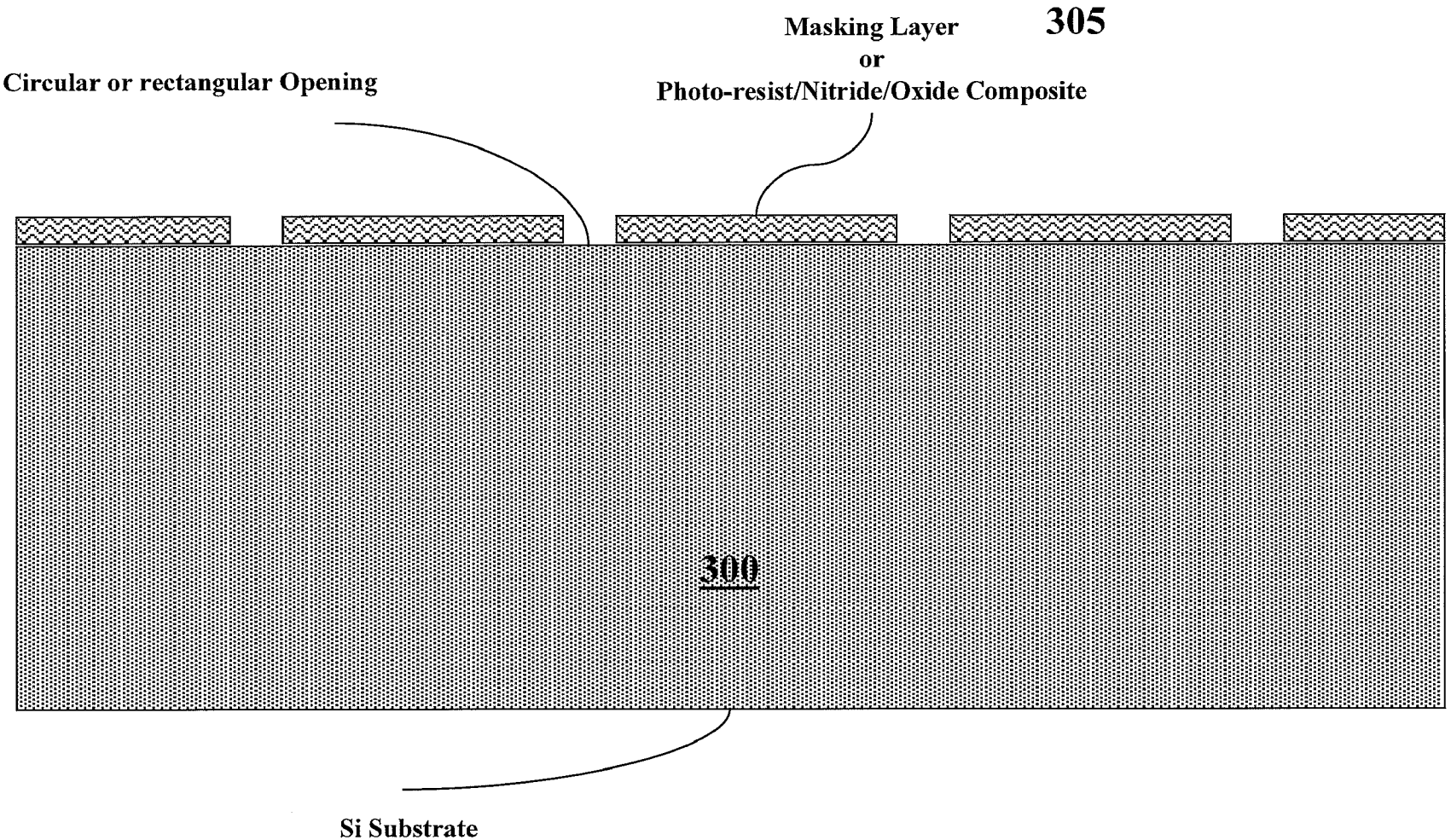
FIG. 3 illustrates an initial masking step in a manufacturing process for the horn array substrate.
Figure 4:
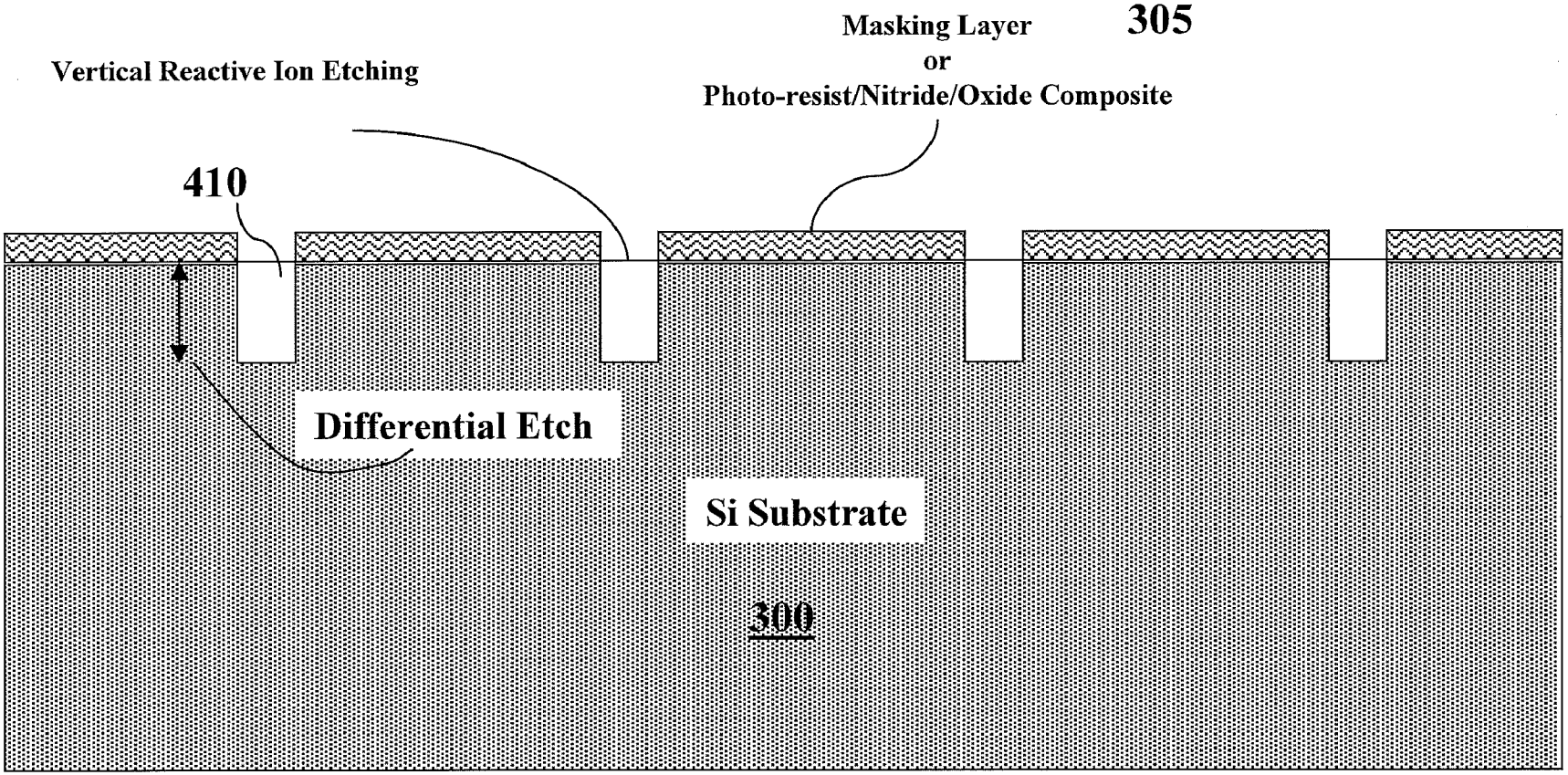
FIG. 4 illustrates an anisotropic etching step for the masked substrate of FIG. 3 to form a first portion of the waveguide chambers that will couple to the horns in the resulting horn array.
Figure 5:
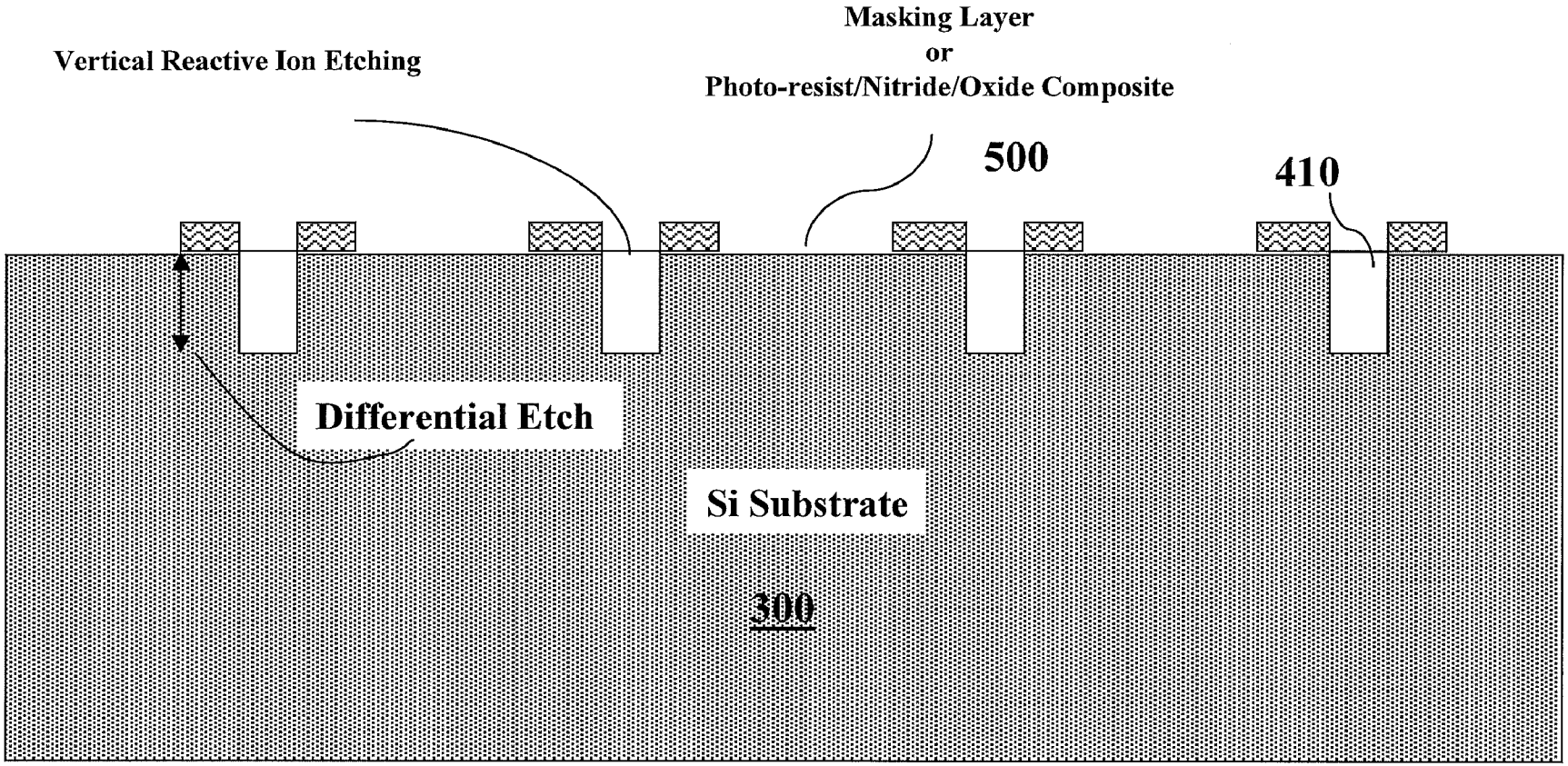
FIG. 5 illustrates a subsequent masking step for the etched substrate of FIG. 4.
Figure 6:
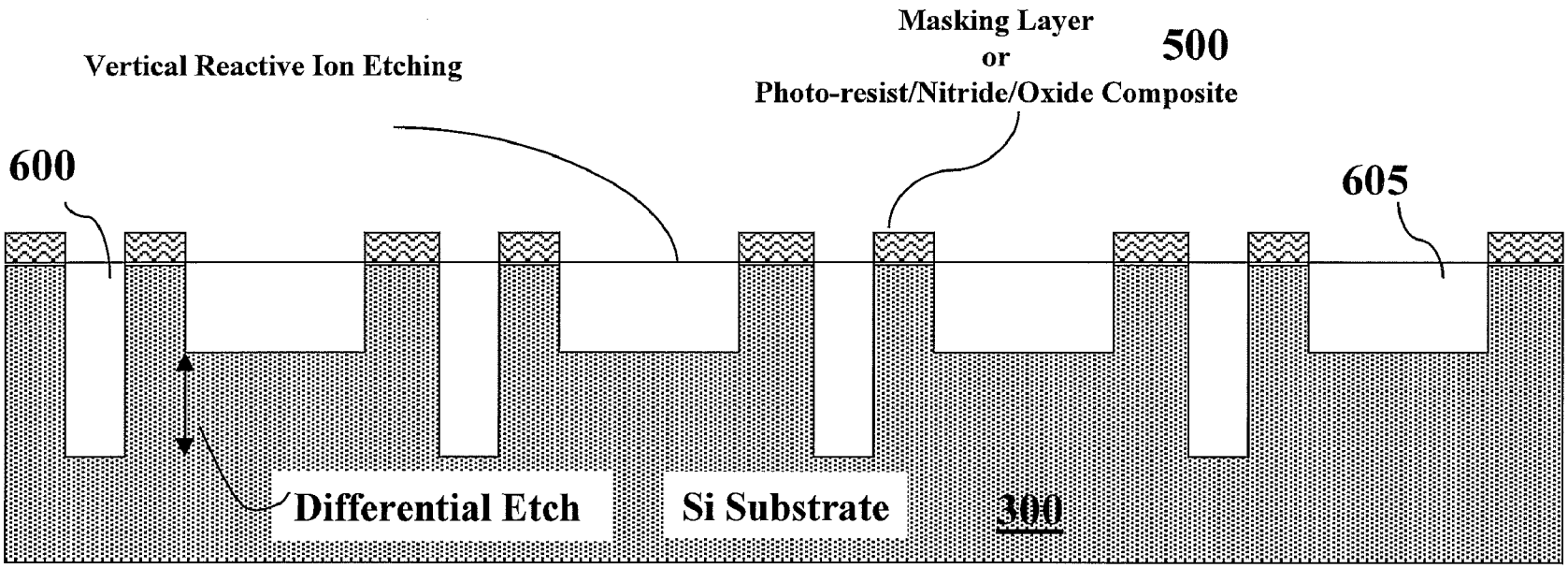
FIG. 6 illustrates an additional anisotropic etching step for the masked substrate of FIG. 5 that completes the waveguide chambers and forms lower horn isolation cavities.
Figure 7:
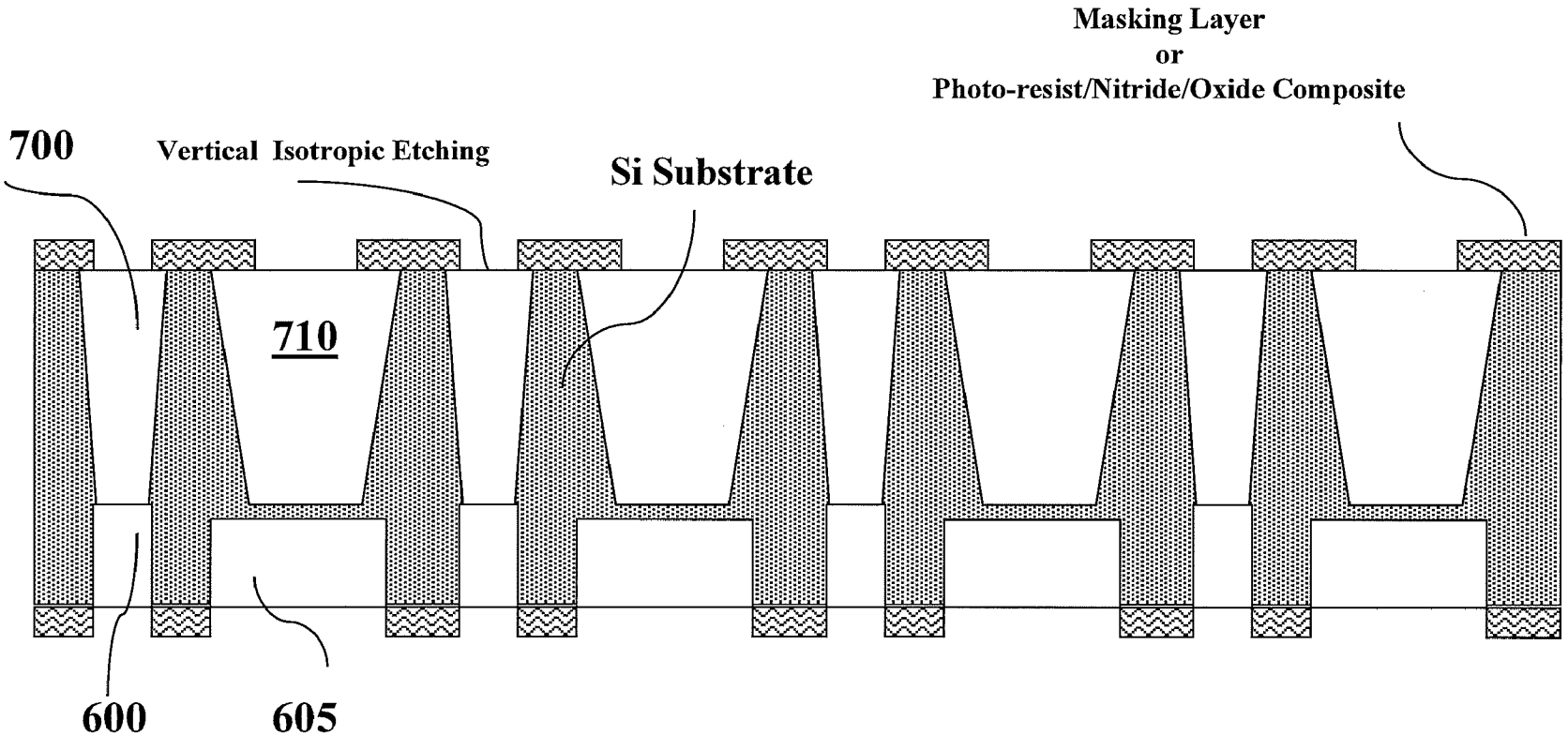
FIG. 7 illustrates an isotropic etching step for an opposing surface of the substrate of FIG. 6 to complete the horn cavities and to form upper horn isolations cavities.
Figure 8:
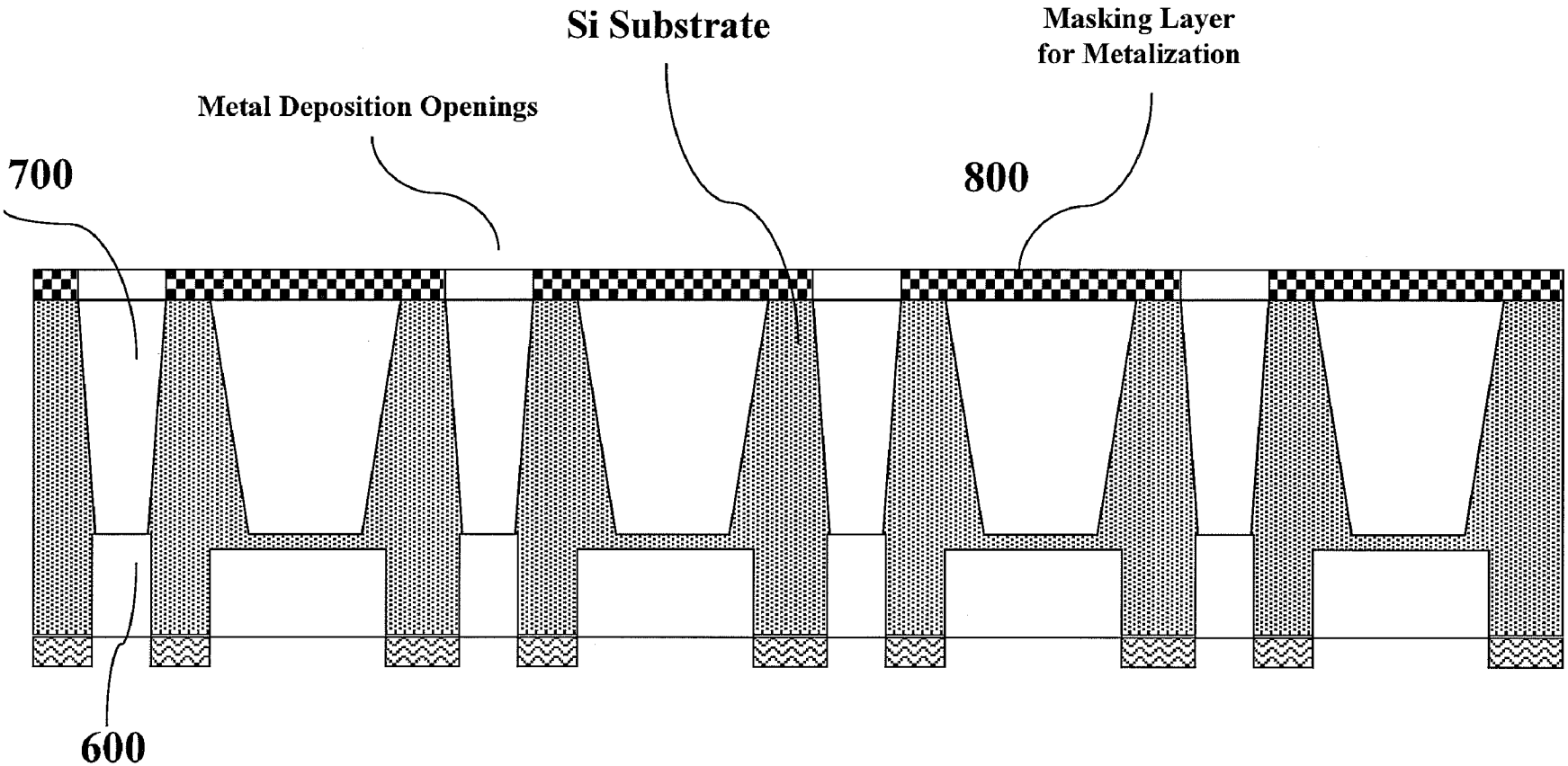
FIG. 8 illustrates a masking step before metallization of the horn cavities.

Having discussed the myriad embodiments that may be used to form macro layer II, the horn antenna layer (macro layer I) will now be discussed. Advantageously, the horn antenna array construction is compatible with standard integrated circuit processing techniques. Both surfaces of a semiconductor substrate (or other suitable substrate) may be processed to form the horn arrays. For example, as seen in FIG. 3, a silicon substrate 300 (or other suitable semiconductor substrate) may have a masking layer 305 such as photoresist patterned to form circular or rectangular openings. The geometry (circular or rectangular) of these openings depends upon the type of waveguide desired to feed the horn antennas. As known in the arts, the geometry of the waveguide determines the type of electromagnetic propagation modes in the waveguides and thus ultimately determines the type of polarization that will be produced by the corresponding horns. As seen in FIG. 4, the substrate is then anisotropically etched using, for example, a reactive ion etching to form portions of waveguide cavities 410. To assist in the formation of isolation cavities between the horns, the silicon substrate is again masked with a patterned masking layer 500 as seen in FIG. 5. This resulting substrate is again anistropically etched as shown in FIG. 6 to form completed waveguide cavities and lower isolation cavities 605. To complete the cavities for the horns, the opposing surface of substrate 300 is masked and patterned as shown in FIG. 7. To provide the appropriate flaring to the resulting horns 700, substrate 300 is isotropically etched. Upper isolation cavities 710 will thus also be flared as well although that is not important for the corresponding isolation they provide to the horns. Referring back to FIGS. 4 and 5, the reduced etching (as compared to waveguide portions 600) that lower isolation cavities received results in the preservation of a substrate layer between upper and lower isolation cavities 710 and 605. This preservation of substrate in the isolation cavities is desirable to provide structural rigidity and mechanical support to the resulting horn array. The horns may now be metallized by the application of a mask 800. Because this is a standard integrated circuit or MEMs-type process, mask 800 may be formed using an appropriately-patterned template such as a thin aluminum plate. After a metal layer is deposited in the horn cavities, the horn array may be covered by a protective layer 900 as illustrated in FIG. 9 to complete macro layer I.

Figure 9:
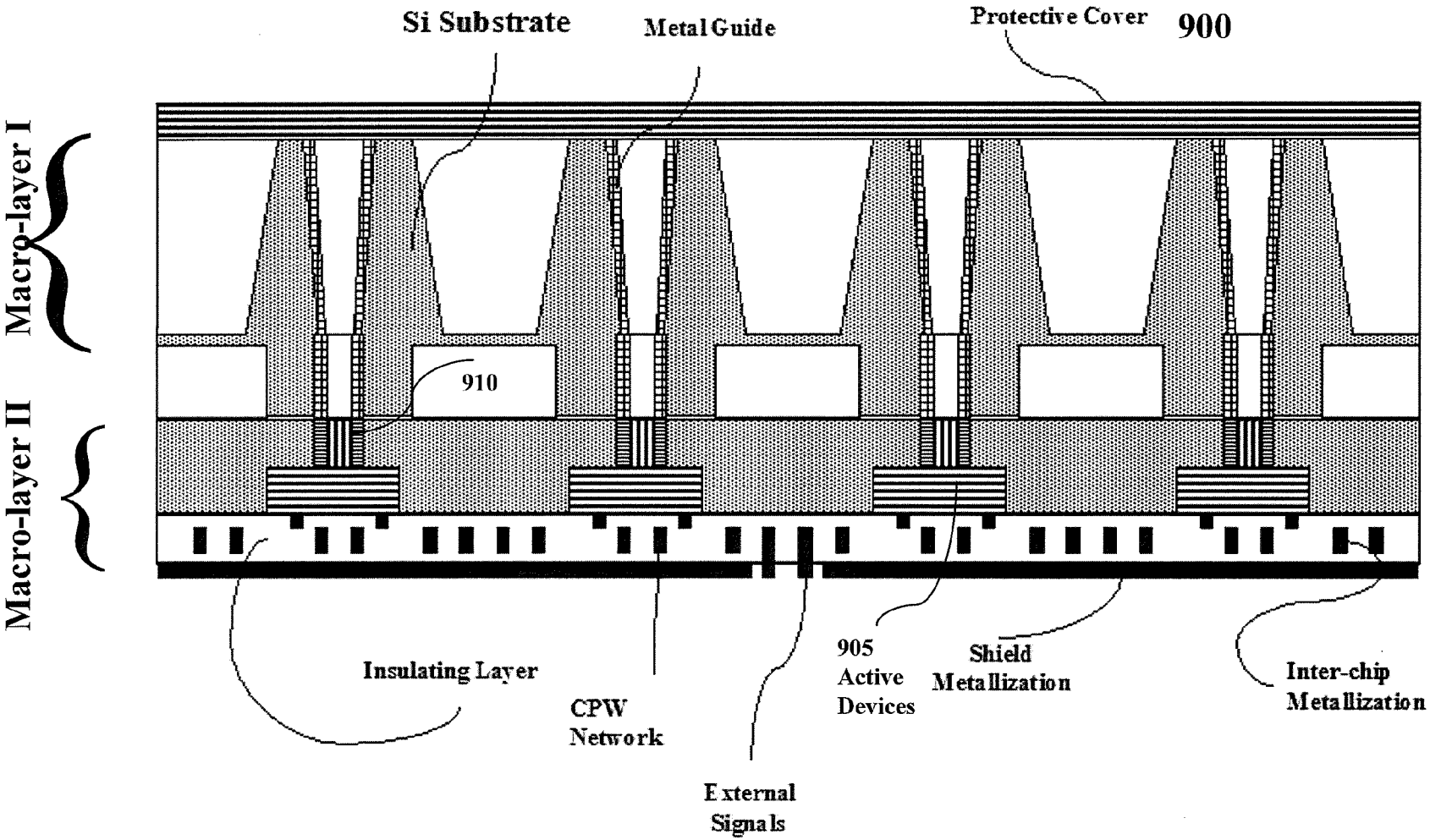
FIG. 9 is a cross-sectional view of a wafer scale antenna module that includes a horn array substrate coupled to active circuitry in a backside embodiment.
Figure 10:
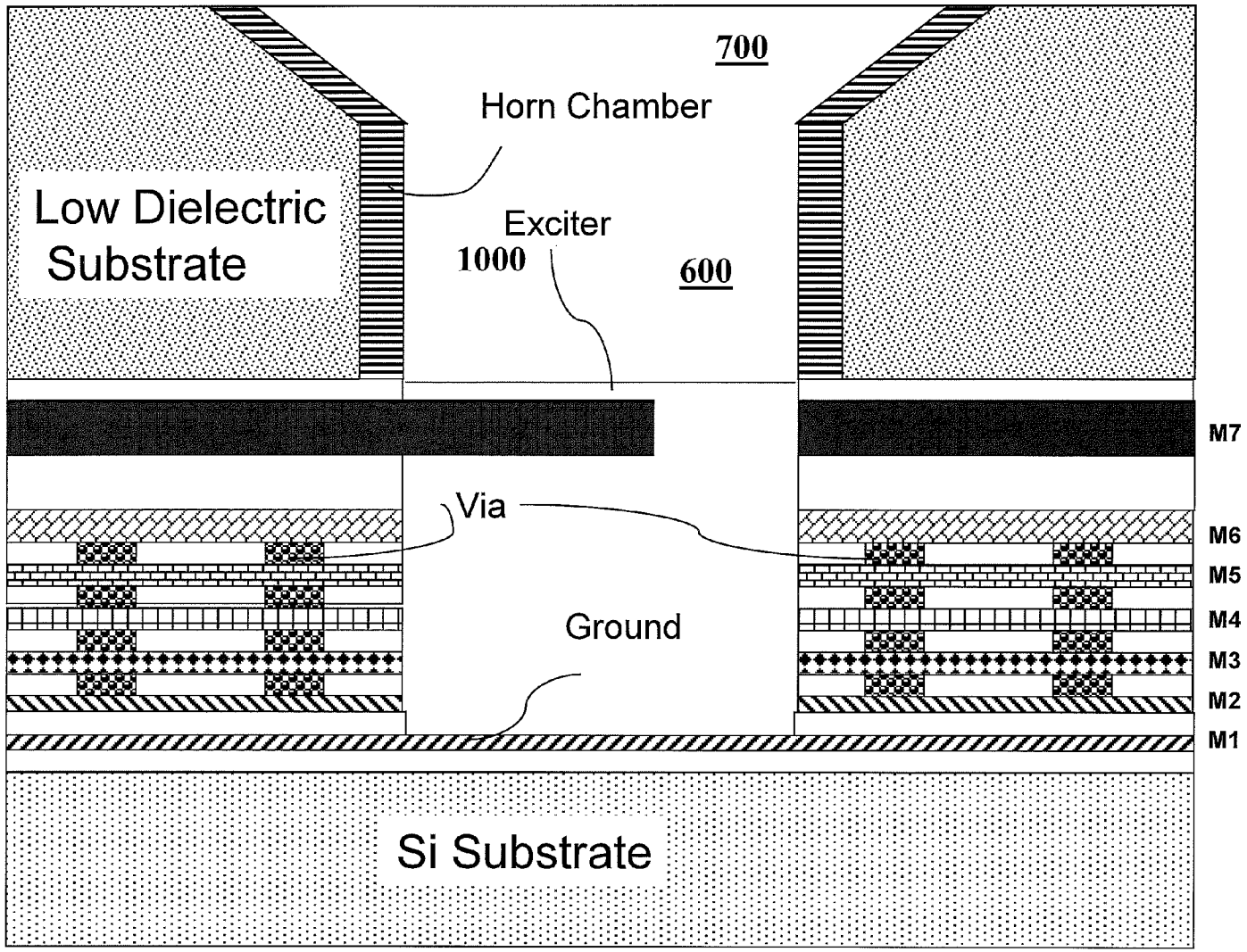
FIG. 10 is a cross-sectional view of a wafer scale antenna module that includes a horn array substrate coupled to active circuitry in a frontside embodiment.

FIG. 9 also shows the integration of macro layers I and II in a backside embodiment. The transistors used to form the desired distributed amplifiers and phase-shifters are shown as active circuitry 905. The CPW transmission network is formed using semiconductor metal layers separated by field oxide insulating layers as discussed previously. Heavily-doped deep conductive junctions 910 couple the active circuitry to the horn antennas so that RF signals may be transmitted and received by the array. Alternatively, a front-side integration may be implemented as seen in FIG. 10. Active circuitry (not illustrated) such as the distributed amplifiers and phase-shifters drive and receive RF signals from the horns. The semiconductor processing metal layers (in this embodiment, layers M1 through M7) are used to form the CPW network if an RF distribution scheme is implemented. Each horn may be inductively coupled to the driving circuitry through metal-layer-formed integrated circuit inductors as discussed, for example, in U.S. Pat. No. 6,963,307, the contents of which are incorporated by reference herein. The inductors include coils coupled by vias as symbolically illustrated in FIG. 10. To drive the horn, the inductor drives an exciter conductor 1000. This exciter excites an appropriate electromagnetic mode in waveguide chamber which then propagates out through horn chamber 700 to radiate to the outside world.

It will be obvious to those skilled in the art that various changes and modifications may be made without departing from this invention in its broader aspects. The appended claims encompass all such changes and modifications as fall within the true spirit and scope of this invention.

I claim:

1. An integrated circuit horn array, comprising:

a first substrate including a plurality of horn antennas, the horn antennas being isolated by cavities in the first substrate between the horn antennas;

a second substrate adjacent the first substrate;

an RF feed network adjacent the second substrate and coupled to the pulse shaping circuit, the RF feed network being configured to propagate an RF signal to the plurality of horn antennas, and a distributed plurality of amplifiers integrated with the second substrate and operable to amplify the RF signal propagated through the RF feed network.

2. The integrated circuit horn array of claim 1, wherein the RF feed network is a coplanar waveguide (CPW) network.

3. The integrated circuit horn array of claim 2, wherein the CPW network is formed in semiconductor manufacturing metal layers associated with the second substrate.

4. The integrated circuit horn array of claim 3, wherein the second substrate has a front surface facing the first substrate and a back surface facing away from the first substrate, and wherein the CPW network is adjacent the front surface.

5. The integrated circuit horn array of claim 3, wherein the second substrate has a front surface facing the first substrate and a back surface facing away from the first substrate, and wherein the CPW network is adjacent the back surface.

6. The integrated circuit horn array of claim 1, wherein the first substrate has a first surface and a second opposing surface, and wherein each isolation cavity comprises a first isolation cavity extending from the first surface towards the second opposing surface and a second isolation cavity extending from the second surface towards the first surface such that the first and second isolation cavities are separated by a portion of the first substrate.

7. An integrated circuit horn array, comprising:

a first substrate including a plurality of horn antennas, the horn antennas being isolated by cavities in the first substrate between the horn antennas;

a second substrate adjacent the first substrate; and an RF feed network adjacent the second substrate, the RF feed network coupling to a distributed plurality of amplifiers integrated with the second substrate, wherein the RF feed network and the distributed plurality of amplifiers are configured to form a resonant network such that if a timing signal is injected into an input port of the RF feed network, the resonant network oscillates to provide a globally synchronized RF signal to each of the horn antennas.

8. The integrated circuit horn array of claim 7, wherein the RF feed network is implemented using waveguides selected from the group consisting of microstrip waveguides, co-planar waveguides, and planar waveguides.

9. The integrated circuit horn array of claim 8, wherein the RF feed network is a coplanar waveguide (CPW) network.

10. The integrated circuit horn array of claim 9, wherein the CPW network is formed in semiconductor manufacturing metal layers associated with the second substrate.

11. The integrated circuit horn array of claim 10, wherein the second substrate has a front surface facing the first substrate and a back surface facing away from the first substrate, and wherein the CPW network is adjacent the front surface.

12. The integrated circuit horn array of claim 10, wherein the second substrate has a front surface facing the first substrate and a back surface facing away from the first substrate, and wherein the CPW network is adjacent the back surface.

13. The integrated circuit horn array of claim 7, wherein the first substrate has a first surface and a second opposing surface, and wherein each isolation cavity comprises a first isolation cavity extending from the first surface towards the second opposing surface and a second isolation cavity extending from the second surface towards the first surface such that the first and second isolation cavities are separated by a portion of the first substrate.

14. An integrated circuit horn array, comprising:

a first substrate including a plurality of horn antennas, the horn antennas being isolated by cavities in the first substrate between the horn antennas;

a second substrate adjacent the first substrate; and a plurality of oscillators integrated into the second substrate, wherein each oscillator corresponds uniquely with an antenna and provides a local oscillator signal that is upconverted to drive its corresponding antenna.

* * * * *